US010668760B2

(12) United States Patent
Kaniewska et al.

(10) Patent No.: US 10,668,760 B2
(45) **Date of Patent: *Jun. 2, 2020**

(54) FREQUENCY BAND EXTENSION IN AN AUDIO SIGNAL DECODER

(71) Applicant: KONINKLIJKE PHILIPS N.V., Eindhoven (NL)

(72) Inventors: Magdalena Kaniewska, Leuven (BE); Stephane Ragot, Lannion (FR)

(73) Assignee: Koninklijke Philips N.V., Eindhoven (NL)

( * ) Notice: Subject to any disclaimer, the term of this patent is extended or adjusted under 35 U.S.C. 154(b) by 78 days.

This patent is subject to a terminal disclaimer.

(21) Appl. No.: 15/869,560

(22) Filed: Jan. 12, 2018

(65) Prior Publication Data

US 2018/0141361 A1 May 24, 2018

Related U.S. Application Data

(62) Division of application No. 15/117,100, filed as application No. PCT/FR2015/050257 on Feb. 4, 2015, now Pat. No. 10,043,525.

(30) Foreign Application Priority Data

Feb. 7, 2014 (FR) ..... 14 50969

(51) Int. Cl.
*G10L 19/00* (2013.01)
*B41K 3/56* (2006.01)
(Continued)

(52) U.S. Cl.
CPC ..... *B41K 3/56* (2013.01); *B41K 1/04* (2013.01); *B41K 1/10* (2013.01); *B41K 1/12* (2013.01);
(Continued)

(58) Field of Classification Search
CPC ..... G10L 19/00; G10L 19/26
See application file for complete search history.

(56) References Cited

U.S. PATENT DOCUMENTS 6,138,093 A * 10/2000 Ekudden ..... G10L 19/26 704/205
7,546,237 B2 * 6/2009 Nongpiur ..... G10L 21/0364 704/209

(Continued)

FOREIGN PATENT DOCUMENTS

JP 2000181496 A 6/2000
WO 2013066238 A2 5/2013

OTHER PUBLICATIONS

Harinarayanan, et al., 124th Audio Engineering Society AES Convention, 2008.*

(Continued)

*Primary Examiner* — Feng-Tzer Tzeng

(57) ABSTRACT

A method is provided for extending the frequency band of an audio signal during a decoding or improvement process. The method includes obtaining the decoded signal in a first frequency band, referred to as a low band. Tonal components and a surround signal are extracted from the signal from the low-band signal, and the tonal components and the surround signal are combined by adaptive mixing using energy-level control factors to obtain an audio signal, referred to as a combined signal. The low-band decoded signal before the extraction step or the combined signal after the combination step are extended over at least one second frequency band which is higher than the first frequency band. Also proved are a frequency-band extension device which implements the described method and a decoder including a device of this type.

13 Claims, 5 Drawing Sheets

(51) Int. Cl.

| | |
|---|---|
| ***G10L 21/038*** | (2013.01) |
| ***B41K 1/04*** | (2006.01) |
| ***B41K 1/10*** | (2006.01) |
| ***B41K 1/12*** | (2006.01) |
| ***B41K 1/38*** | (2006.01) |
| ***B41K 1/40*** | (2006.01) |
| ***B41K 1/42*** | (2006.01) |
| ***G10L 19/02*** | (2013.01) |
| ***G10L 25/21*** | (2013.01) |
| *G10L 19/26* | (2013.01) |

(52) U.S. Cl.

CPC ..... *B41K 1/38* (2013.01); *B41K 1/40* (2013.01); *B41K 1/42* (2013.01); *G10L 19/0204* (2013.01); *G10L 21/038* (2013.01); *G10L 25/21* (2013.01); *G10L 19/00* (2013.01); *G10L 19/26* (2013.01)

(56) References Cited

U.S. PATENT DOCUMENTS

| | | | | |
|---|---|---|---|---|
| 8,463,599 | B2 * | 6/2013 | Ramabadran | G10L 19/06 704/205 |
| 9,666,202 | B2 * | 5/2017 | Gao | G10L 19/0204 |
| 2001/0044722 | A1 | 11/2001 | Gustafason | |
| 2011/0075832 | A1 | 3/2011 | Tashiro | |
| 2011/0288873 | A1 * | 11/2011 | Nagel | G10L 19/265 704/500 |
| 2012/0230515 | A1 * | 9/2012 | Grancharov | G10L 21/038 381/98 |
| 2014/0257827 | A1 | 9/2014 | Norvell | |
| 2015/0255073 | A1 * | 9/2015 | Gao | G10L 21/038 704/500 |

OTHER PUBLICATIONS

Harinarayanan, et al., New Enhancements to the Audio Bandwidth Extension Toolkit (ABET), 124th Audio Engineering Society AES Convention, 2008. (Year: 2008).*

Harinarayanan et al "New Enhancements to the Audio Bandwidth Extension Toolkit" Audion Engineering Society, May 17-20, 2008.

International Search Report dated Apr. 20, 2015 for corresponding International Application No. PCT/FR2015/050257, filed Feb. 4, 2015.

Annadana Raghuram et al., "New Enhancements to the Audio Bandwidth Extension Toolkit (ABET)" AES Convention 124, May 2008, AES 60 East 42nd Street, Room 2520 New york, 10165-2520, USA, May 1, 2008, XP040508704.

English Translation of the International Written Opinion dated Apr. 20, 2015 for corresponding International Application No. PCT/FR2015/050257, filed Feb. 4, 2015.

Ramabadran, Tenkasi et al "Artificial Bandwidth Extension of Narrow-band Speech Signals via High-band Energy Estimation", 16th European Signal Processing Conference, Aug. 2008.

Fuchs, Guillaume et al "A New Post-Filtering for Artificially Replicated High-Band in Speech Coders" ICASSP 2006.

* cited by examiner

FREQUENCY BAND EXTENSION IN AN AUDIO SIGNAL DECODER

CROSS-REFERENCE TO RELATED APPLICATIONS

This application is a Divisional of U.S. Ser. No. 15/117,100, filed Aug. 5, 2016, which is the National Stage Application of International Application No. PCT/FR2015/050257, filed Feb. 4, 2015, the content of which is incorporated herein by reference in its entirety, and published as WO2015/118260 on Aug. 13, 2015, not in English, which also claims priority of French Application no. 1450969, filed Feb. 7, 2014.

FIELD OF THE DISCLOSURE

The present invention relates to the field of the coding/decoding and the processing of audio frequency signals (such as speech, music or other such signals) for their transmission or their storage.

More particularly, the invention relates to a frequency band extension method and device in a decoder or a processor producing an audio frequency signal enhancement.

BACKGROUND OF THE DISCLOSURE

Numerous techniques exist for compressing (with loss) an audio frequency signal such as speech or music.

The conventional coding methods for conversational applications are generally classified as waveform coding (PCM for "Pulse Code Modulation", ADCPM for "Adaptive Differential Pulse Code Modulation", transform coding, etc.), parametric coding (LPC for "Linear Predictive Coding", sinusoidal coding, etc.) and parametric hybrid coding with a quantization of the parameters by "analysis by synthesis" of which CELP ("Code Excited Linear Prediction") coding is the best known example.

For non-conversational applications, the prior art for (mono) audio signal coding consists of perceptual coding by transform or in sub-bands, with a parametric coding of the high frequencies by band replication (SBR for Spectral Band Replication).

A review of the conventional speech and audio coding methods can be found in the works by W. B. Kleijn and K. K. Paliwal (eds.), Speech Coding and Synthesis, Elsevier, 1995, M. Bosi, R. E. Goldberg, Introduction to Digital Audio Coding and Standards, Springer 2002; J. Benesty, M. M. Sondhi, Y. Huang (eds.), Handbook of Spe4ech Processing, Springer 2008.

The focus here is more particularly on the 3GPP standardized AMR-WB ("Adaptive Multi-Rate Wideband") codec (coder and decoder), which operates at an input/output frequency of 16 kHz and in which the signal is divided into two sub-bands, the low band (o-6.4 kHz) which is sampled at 12.8 kHz and coded by CELP model and the high band (6.4-7 kHz) which is reconstructed parametrically by "band extension" (or BWE, for "Bandwidth Extension") with or without additional information depending on the mode of the current frame. It can be noted here that the limitation of the coded band of the AMR-WB codec at 7 kHz is essentially linked to the fact that the frequency response in transmission of the wideband terminals was approximated at the time of standardization (ETSI/3GPP then ITU-T) according to the frequency mask defined in the standard ITU-T P.341 and more specifically by using a so-called "P341" filter defined in the standard ITU-T G.191 which cuts the frequencies above 7 kHz (this filter observes the mask defined in P.341). However, in theory, it is well known that a signal sampled at 16 kHz can have a defined audio band from 0 to 8000 Hz; the AMR-WB codec therefore introduces a limitation of the high band by comparison with the theoretical bandwidth of 8 kHz.

The 3GPP AMR-WB speech codec was standardized in 2001 mainly for the circuit mode (CS) telephony applications on GSM (2G) and UMTS (3G). This same codec was also standardized in 2003 by the ITU-T in the form of recommendation G.722.2 "Wideband coding speech at around 16 kbit/s using Adaptive Multi-Rate Wideband (AMR-WB)".

It comprises nine bit rates, called modes, from 6.6 to 23.85 kbit/s, and comprises continuous transmission mechanisms (DTX, for "Discontinuous Transmission") with voice activity detection (VAD) and comfort noise generation (CNG) from silence description frames (SID, for "Silence Insertion Descriptor"), and lost frame correction mechanisms (FEC for "Frame Erasure Concealment", sometimes called PLC, for "Packet Loss Concealment").

The details of the AMR-WB coding and decoding algorithm are not repeated here; a detailed description of this codec can be found in the 3GPP specifications (TS 26.190, 26.191, 26.192, 26.193, 26.194, 26.204) and in ITU-T-G.722.2 (and the corresponding annexes and appendix) and in the article by B. Bessette et al. entitled "The adaptive multirate wideband speech codec (AMR-WB)", IEEE Transactions on Speech and Audio Processing, vol. 10, no. 8, 2002, pp. 620-636 and the source codes of the associated 3GPP and ITU-T standards.

The principle of band extension in the AMR-WB codec is fairly rudimentary. Indeed, the high band (6.4-7 kHz) is generated by shaping a white noise through a time (applied in the form of gains per sub-frame) and frequency (by the application of a linear prediction synthesis filter or LPC, for "Linear Predictive Coding") envelope. This band extension technique is illustrated in FIG. 1.

A white noise $u_{HB1}(n)$, n=0, . . . , 79 is generated at 16 kHz for each 5 ms sub-frame by linear congruential generator (block 100). This noise $u_{HB1}(n)$ is shaped in time by application of gains for each sub-frame; this operation is broken down into two processing steps (blocks 102, 106 or 109):

A first factor is computed (block 101) to set the white noise $u_{HB1}(n)$ (block 102) at a level similar to that of the excitation, u(n), =0, . . . , 63, decoded at 12.8 kHz in the low band:

$$u_{HB2}(n) = u_{HB1}(n)\sqrt{\frac{\sum_{l=0}^{63} u(l)^2}{\sum_{l=0}^{79} u_{HB1}(l)^2}}$$

It can be noted here that the normalization of the energies is done by comparing blocks of different size (64 for u(n) and 80 for $u_{HB1}(n)$) without compensation of the differences in sampling frequencies (12.8 or 16 kHz).

The excitation in the high band is then obtained (block 106 or 109) in the form:

$$u_{HB}(n)=\hat{g}_{HB}u_{HB2}(n)$$

in which the gain $\hat{g}_{HB}$ is obtained differently depending on the bit rate. If the bit rate of the current frame is <23.85 kbit/s, the gain $\hat{g}_{HB}$ is estimated "blind" (that is to say without additional information); in this case, the block 103 filters the signal decoded in low band by a high-pass filter having a cut-off frequency at 400 Hz to obtain a signal $\hat{s}_{hp}(n)$, n=0, . . . , 63—this high-pass filter eliminates the influence of the very low frequencies which can skew the estimation made in the block 104—then the "tilt" (indicator of spectral slope) denoted $e_{tilt}$ of the signal $\hat{s}_{hp}(n)$ is computed by normalized self-correlation (block 104):

$$e_{tilt} = \frac{\sum_{n=1}^{63} \hat{s}_{hp}(n)\hat{s}_{hp}(n-1)}{\sum_{n=0}^{63} \hat{s}_{hp}(n)^2}$$

and finally, $\hat{g}_{HB}$ is computed in the form:

$$\hat{g}_{HB}=w_{SP}g_{SP}+(1-w_{SP})g_{BG}$$

in which $g_{SP}=1-e_{tilt}$ is the gain applied in the active speech (SP) frames, $g_{BG}=1.25g_{SP}$ is the gain applied in the inactive speech frames associated with a background (BG) noise and $w_{SP}$ is a weighting function which depends on the voice activity detection (VAD). It is understood that the estimation of the tilt ($e_{tilt}$) makes it possible to adapt the level of the high band as a function of the spectral nature of the signal; this estimation is particularly important when the spectral slope of the CELP decoded signal is such that the average energy decreases when the frequency increases (case of a voiced signal where $e_{tilt}$ is close to 1, therefore $g_{SP}=1-e_{tilt}$ is thus reduced). It should also be noted that the factor $\hat{g}_{HB}$ in the AMR-WB decoding is bounded to take values within the interval [0.1, 1.0]. In fact, for the signals whose spectrum has more energy at high frequencies ($e_{tilt}$ close to −1, $g_{SP}$ close to 2), the gain $\hat{g}_{HB}$ is usually under-estimated.

At 23.85 kbit/s, a correction information item is transmitted by the AMR-WB coder and decoded (blocks 107, 108) in order to refine the gain estimated for each sub-frame (4 bits every 5 ms, or 0.8 kbit/s).

The artificial excitation $u_{HB}(n)$ is thereafter filtered (block 111) by an LPC synthesis filter with transfer function $1/A_{HB}(z)$ and operating at the sampling frequency of 16 kHz. The construction of this filter depends on the bit rate of the current frame:

At 6.6 kbit/s, the filter $1/A_{HB}(z)$ is obtained by weighting by a factor γ=0.9 an LPC filter of order 20, $1/\hat{A}^{ext}(z)$, which "extrapolates" the LPC filter of order 16, $1/\hat{A}(z)$, decoded in the low band (at 12.8 kHz)—the details of the extrapolation in the realm of the ISF (Imittance Spectral Frequency) parameters are described in the standard G.722.2 in section 6.3.2.1; in this case, $$1/A_{HB}(z)=1/\hat{A}^{ext}(z/\gamma)$$

At the bit rates >6.6 kbit/s, the filter $1/A_{HB}(z)$ is of order 16 and corresponds simply to:

$$1/A_{HB}(z)=1/\hat{A}(z/\gamma)$$

where γ=0.6. It should be noted that, in this case, the filter $1/\hat{A}(z/\gamma)$ is used at 16 kHz, which results in a spreading (by proportional transformation) of the frequency response of this filter from [0, 6.4 kHz] to [0, 8 kHz].

The result, $s_{HB}(n)$, is finally processed by a bandpass filter (block 112) of FIR ("Finite Impulse Response") type, to keep only the 6-7 kHz band; at 23.85 kbit/s, a low-pass filter also of FIR type (block 113) is added to the processing to further attenuate the frequencies above 7 kHz. The high frequency (HF) synthesis is finally added (block 130) to the low frequency (LF) synthesis obtained with the blocks 120 to 123 and resampled at 16 kHz (block 123). Thus, even if the high band extends in theory from 6.4 to 7 kHz in the AMR-WB codec, the HF synthesis is rather contained in the 6-7 kHz band before addition with the LF synthesis.

A number of drawbacks in the band extension technique of the AMR-WB codec can be identified:

The signal in the high band is a shaped white noise (shaped by temporal gains for each sub-frame, by filtering by $1/A_{HB}(z)$ and bandpass filtering), which is not a good general model of the signal in the 6.4-7 kHz band. There are, for example, very harmonic music signals for which the 6.4-7 kHz band contains sinusoidal components (or tones) and no noise (or little noise); for these signals the band extension of the AMR-WB codec greatly degrades the quality.

The low-pass filter at 7 kHz (block 113) introduces a shift of almost 1 ms between the low and high bands, which can potentially degrade the quality of certain signals by slightly desynchronizing the two bands at 23.85 kbit/s—this desynchronization can also pose problems when switching bit rate from 23.85 kbit/s to other modes.

The estimation of gains for each sub-frame (block 101, 103 to 105) is not optimal. Partly, it is based on an equalization of the "absolute" energy per sub-frame (block 101) between signals at different frequencies: artificial excitation at 16 kHz (white noise) and a signal at 12.8 kHz (decoded ACELP excitation). It can be noted in particular that this approach implicitly induces an attenuation of the high-band excitation (by a ratio 12.8/16=0.8); in fact, it will also be noted that no de-emphasis is performed on the high band in the AMR-WB codec, which implicitly induces an amplification relatively close to 0.6 (which corresponds to the value of the frequency response of $1/(1-0.68\,z^{-1})$ at 6400 Hz). In fact, the factors of 1/0.8 and of 0.6 are compensated approximately.

Regarding speech, the 3GPP AMR-WB codec characterization tests documented in the 3GPP report TR 26.976 have shown that the mode at 23.85 kbit/s has a less good quality than at 23.05 kbit/s, its quality being in fact similar to that of the mode at 15.85 kbit/s. This shows in particular that the level of artificial HF signal has to be controlled very prudently, because the quality is degraded at 23.85 kbit/s whereas the 4 bits per frame are considered to make it possible to best approximate the energy of the original high frequencies.

The limitation of the coded band to 7 kHz results from the application of a strict model of the transmission response of the acoustic terminals (filter P.341 in the ITU-T G.191 standard). Now, for a sampling frequency of 16 kHz, the frequencies in the 7-8 kHz band remain important, particularly for the music signals, to ensure a good quality level.

The AMR-WB decoding algorithm has been improved partly with the development of the scalable ITU-T G.718 codec which was standardized in 2008.

The ITU-T G.718 standard comprises a so-called interoperable mode, for which the core coding is compatible with the G.722.2 (AMR-WB) coding at 12.65 kbit/s; furthermore, the G.718 decoder has the particular feature of being able to decode an AMR-WB/G.722.2 bit stream at all the possible bit rates of the AMR-WB codec (from 6.6 to 23.85 kbit/s).

The G.718 interoperable decoder in low delay mode (G.718-LD) is illustrated in FIG. 2. Below is a list of the improvements provided by the AMR-WB bit stream decoding functionality in the G.718 decoder, with references to FIG. 1 when necessary:

The band extension (described for example in clause 7.13.1 of Recommendation G.718, block 206) is identical to that of the AMR-WB decoder, except that the 6-7 kHz bandpass filter and $1/A_{HB}(z)$ synthesis filter (blocks 111 and 112) are in reverse order. In addition, at 23.85 kbit/s, the 4 bits transmitted per sub-frames by the AMR-WB coder are not used in the interoperable G.718 decoder; the synthesis of the high frequencies (HF) at 23.85 kbit/s is therefore identical to 23.05 kbit/s which avoids the known problem of AMR-WB decoding quality at 23.85 kbit/s. A fortiori, the 7 kHz low-pass filter (block 113) is not used, and the specific decoding of the 23.85 kbit/s mode is omitted (blocks 107 to 109).

A post-processing of the synthesis at 16 kHz (see clause 7.14 of G.718) is implemented in G.718 by "noise gate" in the block 208 (to "enhance" the quality of the silences by reduction of the level), high-pass filtering (block 209), low frequency post-filter (called "bass posfilter") in the block 210 attenuating the cross-harmonic noise at low frequencies and a conversion to 16 bit integers with saturation control (with gain control or AGC) in the block 211.

However, the band extension in the AMR-WB and/or G.718 (interoperable mode) codecs is still limited on a number of aspects.

In particular, the synthesis of high frequencies by shaped white noise (by a temporal approach of LPC source-filter type) is a very limited model of the signal in the band of the frequencies higher than 6.4 kHz.

Only the 6.4-7 kHz band is re-synthesized artificially, whereas in practice a wider band (up to 8 kHz) is theoretically possible at the sampling frequency of 16 kHz, which can potentially enhance the quality of the signals, if they are not pre-processed by a filter of P.341 type (50-7000 Hz) as defined in the *Software Tool Library* (standard G.191) of the ITU-T.

A need therefore exists to improve the band extension in a codec of AMR-WB type or an interoperable version of this codec or more generally to improve the band extension of an audio signal, in particular so as to improve the frequency content of the band extension.

SUMMARY

An exemplary embodiment of the present disclosure relates to a method for extending frequency band of an audio frequency signal during a decoding or improvement process comprising a step of obtaining the signal decoded in a first frequency band termed the low band. The method is such that it comprises the following steps:

- extraction of tonal components and of an ambience signal from a signal arising from the decoded low band signal;
- combination of the tonal components and of the ambience signal by adaptive mixing using energy level control factors to obtain an audio signal, termed the combined signal;
- extension on at least one second frequency band higher than the first frequency band of the low band decoded signal before the extraction step or of the combined signal after the combining step.

It will be noted that subsequently "band extension" will be taken in the broad sense and will include not only the case of the extension of a sub-band at high frequencies but also the case of a replacement of sub-bands that are set to zero (of "noise filling" type in transform coding).

Thus, at one and the same time by taking into account tonal components and an ambience signal extracted from the signal arising from the decoding of the low band, it is possible to perform the band extension with a signal model suited to the true nature of the signal in contradistinction to the use of artificial noise. The quality of the band extension is thus improved and in particular for certain types of signals such as music signals.

Indeed, the signal decoded in the low band comprises a part corresponding to the sound ambience which can be transposed into high frequency in such a way that a mixing of the harmonic components and of the existing ambience makes it possible to ensure a coherent reconstructed high band.

It will be noted that, even if the invention is motivated by the enhancement of the quality of the band extension in the context of the interoperable AMR-WB coding, the different embodiments apply to the more general case of the band extension of an audio signal, particularly in an enhancement device performing an analysis of the audio signal to extract the parameters necessary to the band extension.

The different particular embodiments mentioned below can be added independently or in combination with one another to the steps of the extension method defined above.

In one embodiment, the band extension is performed in the domain of the excitation and the decoded low band signal is a low band decoded excitation signal.

The advantage of this embodiment is that a transformation without windowing (or equivalently with an implicit rectangular window of the length of the frame) is possible in the domain of the excitation. In this case no artifact (block effects) is then audible.

In a first embodiment, the extraction of the tonal components and of the ambience signal is performed according to the following steps:

- detection of the dominant tonal components of the decoded or decoded and extended low band signal, in the frequency domain;
- computation of a residual signal by extraction of the dominant tonal components to obtain the ambience signal.

This embodiment allows precise detection of the tonal components.

In a second embodiment, of low complexity, the extraction of the tonal components and of the ambience signal is performed according to the following steps:

- obtaining of the ambience signal by computing a mean value of the spectrum of the decoded or decoded and extended low band signal;
- obtaining of the tonal components by subtracting the computed ambience signal from the decoded or decoded and extended low band signal.

In one embodiment of the combining step, a control factor for the energy level used for the adaptive mixing is computed as a function of the total energy of the decoded or decoded and extended low band signal and of the tonal components.

The application of this control factor allows the combining step to adapt to the characteristics of the signal so as to optimize the relative proportion of ambience signal in the mixture. The energy level is thus controlled so as to avoid audible artifacts.

In a preferred embodiment, the decoded low band signal undergoes a step of transform or filter bank-based sub-band decomposition, the extracting and combining steps then being performed in the frequency or sub-band domain.

The implementation of the band extension in the frequency domain makes it possible to obtain a fineness of frequency analysis which is not available with a temporal approach, and makes it possible also to have a frequency resolution that is sufficient to detect the tonal components.

In a detailed embodiment, the decoded and extended low band signal is obtained according to the following equation:

$$U_{HB1}(k) = \begin{cases} 0 & k = 0, \ldots, 199 \\ U(k) & k = 200, \ldots, 239 \\ U(k + \text{start_band} - 240) & k = 240, \ldots, 319 \end{cases}$$

with k the index of the sample, U(k) the spectrum of the signal obtained after a transform step, $U_{HB1}(k)$ the spectrum of the extended signal, and start_band a predefined variable. Thus, this function comprises a resampling of the signal by adding samples to the spectrum of this signal. Other ways of extending the signal are possible however, for example by translation in a sub-band processing.

The present invention also envisages a device for extending frequency band of an audio frequency signal, the signal having been decoded in a first frequency band termed the low band. The device is such that it comprises:

- a module for extracting tonal components and an ambience signal on the basis of a signal arising from the decoded low band signal;
- a module for combining the tonal components and the ambience signal by adaptive mixing using energy level control factors to obtain an audio signal, termed the combined signal;
- a module for extending onto at least one second frequency band higher than the first frequency band and implemented on the low band decoded signal before the extraction module or on the combined signal after the combining module.

This device exhibits the same advantages as the method described previously, that it implements.

The invention targets a decoder comprising a device as described.

It targets a computer program comprising code instructions for the implementation of the steps of the band extension method as described, when these instructions are executed by a processor.

Finally, the invention relates to a storage medium, that can be read by a processor, incorporated or not in the band extension device, possibly removable, storing a computer program implementing a band extension method as described previously.

BRIEF DESCRIPTION OF THE DRAWINGS

Other features and advantages of the invention will become more clearly apparent on reading the following description, given purely as a non-limiting example and with reference to the attached drawings, in which.

DETAILED DESCRIPTION OF ILLUSTRATIVE EMBODIMENTS

Figure 2:
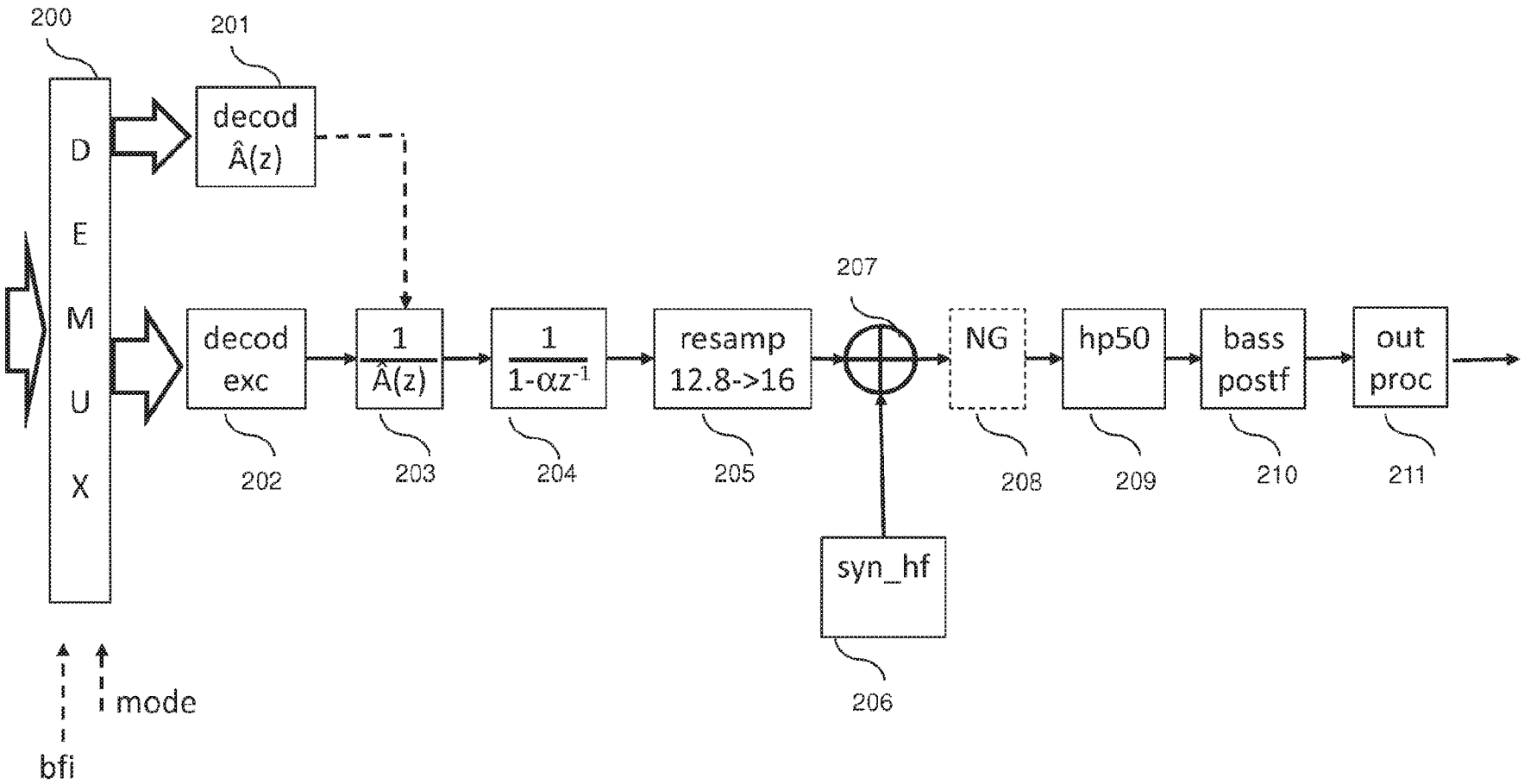
FIG. 2 illustrates a decoder of 16 kHz G.718-LD interoperable type according to the prior art and as described previously.
Figure 3:
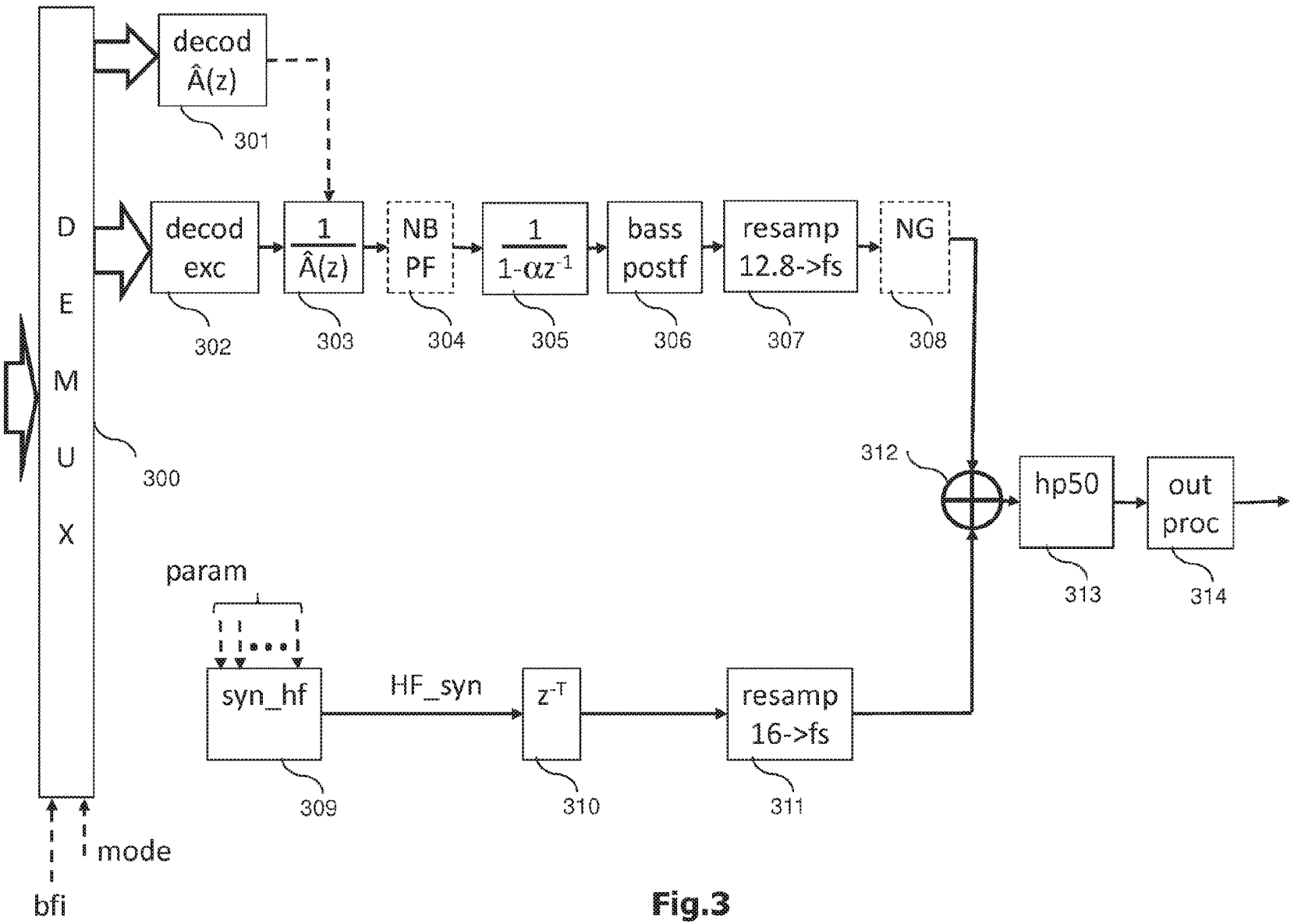
FIG. 3 illustrates a decoder that is interoperable with the AMR-WB coding, incorporating a band extension device according to an embodiment of the invention.

FIG. 3 illustrates an exemplary decoder compatible with the AMR-WB/G.722.2 standard in which there is a post-processing similar to that introduced in G.718 and described with reference to FIG. 2 and an improved band extension according to the extension method of the invention, implemented by the band extension device illustrated by the block 309.

Unlike the AMR-WB decoding which operates with an output sampling frequency of 16 kHz and the G.718 decoder which operates at 8 or 16 kHz, a decoder is considered here which can operate with an output (synthesis) signal at the frequency fs=8, 16, 32 or 48 kHz. Note that it is assumed here that the coding has been performed according to the AMR-WB algorithm with an internal frequency of 12.8 kHz for the low band CELP coding and at 23.85 kbit/s a sub-frame gain coding at the frequency of 16 kHz, but interoperable variants of the AMR-WB coder are also possible; although the invention is described here at the decoding level, it is assumed here that the coding can also operate with an input signal at the frequency fs=8, 16, 32 or 48 kHz and appropriate resampling operations, outside the scope of the invention, are implemented on coding as a function of the value of fs. It may be noted that when fs=8 kHz at the decoder, in the case of a decoding that is compatible with AMR-WB, it is not necessary to extend the 0-6.4 kHz low band, since the reconstructed audio band at the frequency fs is limited to 0-4000 Hz.

In FIG. 3, the CELP decoding (LF for low frequencies) still operates at the internal frequency of 12.8 kHz, as in AMR-WB and G.718, and the band extension (HF for high frequencies) which is the subject of the invention operates at the frequency of 16 kHz, and the LF and HF syntheses are combined (block 312) at the frequency fs after suitable resampling (blocks 307 and 311). In variants of the invention, the combining of the low and high bands can be done at 16 kHz, after having resampled the low band from 12.8 to 16 kHz, before resampling the combined signal at the frequency fs.

The decoding according to FIG. 3 depends on the AMR-WB mode (or bit rate) associated with the current frame received. As an indication, and without affecting the block 309, the decoding of the CELP part in low band comprises the following steps:

- demultiplexing of the coded parameters (block 300) in the case of a frame correctly received (bfi=–0 where bfi is the "bad frame indicator" with a value 0 for a frame received and 1 for a frame lost);
- decoding of the ISF parameters with interpolation and conversion into LPC coefficients (block 301) as described in clause 6.1 of the standard G.722.2;

decoding of the CELP excitation (block 302), with an adaptive and fixed part for reconstructing the excitation (exc or u'(n)) in each sub-frame of length 64 at 12.8 kHz:

$$u'(n)=\hat{g}_p v(n)+\hat{g}_c c(n),\ n=0, \ldots ,63$$

by following the notations of clause 7.1.2.1 of G.718 concerning the CELP decoding, where v(n) and c(n) are respectively the code words of the adaptive and fixed dictionaries, and $\hat{g}_p$ and $\hat{g}_c$ are the associated decoded gains. This excitation u'(n) is used in the adaptive dictionary of the next sub-frame; it is then post-processed and, as in G.718, the excitation u'(n) (also denoted exc) is distinguished from its modified post-processed version u(n) (also denoted exc2) which serves as input for the synthesis filter, $1/\hat{A}(z)$, in the block 303. In variants which can be implemented for the invention, the post-processing operations applied to the excitation can be modified (for example, the phase dispersion can be enhanced) or these post-processing operations can be extended (for example, a reduction of the cross-harmonics noise can be implemented), without affecting the nature of the band extension method according to the invention;

synthesis filtering by $1/\hat{A}(z)$ (block 303) where the decoded LPC filter $\hat{A}(z)$ is of order 16;

narrow-band post-processing (block 304) according to clause 7.3 of G.718 if fs=8 kHz;

de-emphasis (block 305) by the filter $1/(1-0.68\ z^{-1})$.

post-processing of the low frequencies (block 306) as described in clause 7.14.1.1 of G.718. This processing introduces a delay which is taken into account in the decoding of the high band (>6.4 kHz);

re-sampling of the internal frequency of 12.8 kHz at the output frequency fs (block 307). A number of embodiments are possible. Without losing generality, it is considered here, by way of example, that if fs=8 or 16 kHz, the re-sampling described in clause 7.6 of G.718 is repeated here, and if f=32 or 48 kHz, additional finite impulse response (FIR) filters are used;

computation of the parameters of the "noise gate" (block 308) which is performed preferentially as described in clause 7.14.3 of G.718.

In variants which can be implemented for the invention, the post-processing operations applied to the excitation can be modified (for example, the phase dispersion can be enhanced) or these post-processing operations can be extended (for example, a reduction of the cross-harmonics noise can be implemented), without affecting the nature of the band extension. We do not describe here the case of the decoding of the low band when the current frame is lost (bfi=1) which is informative in the 3GPP AMR-WB standard; in general, whether dealing with the AMR-WB decoder or a general decoder relying on the source-filter model, one is typically involved with best estimating the LPC excitation and the coefficients of the LPC synthesis filter so as to reconstruct the lost signal while retaining the source-filter model. When bfi=1 it is considered here that the band extension (block 309) can operate as in the case bfi=–0 and a bitrate <23.85 kbit/s; thus, the description of the invention will subsequently assume, without loss of generality, that bfi=–0.

It can be noted that the use of blocks 306, 308, 314 is optional.

It will also be noted that the decoding of the low band described above assumes a so-called "active" current frame with a bit rate between 6.6 and 23.85 kbit/s. In fact, when the DTX mode is activated, certain frames can be coded as "inactive" and in this case it is possible to either transmit a silence descriptor (on 35 bits) or transmit nothing. In particular, it is recalled that the SID frame of the AMR-WB coder describes several parameters: ISF parameters averaged over 8 frames, mean energy over 8 frames, "dithering flag" for the reconstruction of non-stationary noise. In all cases, in the decoder, there is the same decoding model as for an active frame, with a reconstruction of the excitation and of an LPC filter for the current frame, which makes it possible to apply the invention even to inactive frames. The same observation applies for the decoding of "lost frames" (or FEC, PLC) in which the LPC model is applied.

This exemplary decoder operates in the domain of the excitation and therefore comprises a step of decoding the low band excitation signal. The band extension device and the band extension method within the meaning of the invention also operates in a domain different from the domain of the excitation and in particular with a low band decoded direct signal or a signal weighted by a perceptual filter.

Unlike the AMR-WB or G.718 decoding, the decoder described makes it possible to extend the decoded low band (50-6400 Hz taking into account the 50 Hz high-pass filtering on the decoder, 0-6400 Hz in the general case) to an extended band, the width of which varies, ranging approximately from 50-6900 Hz to 50-7700 Hz depending on the mode implemented in the current frame. It is thus possible to refer to a first frequency band of 0 to 6400 Hz and to a second frequency band of 6400 to 8000 Hz. In reality, in the favored embodiment, the excitation for the high frequencies and generated in the frequency domain in a band from 5000 to 8000 Hz, to allow a bandpass filtering of width 6000 to 6900 or 7700 Hz whose slope is not too steep in the rejected upper band.

Figure 5:
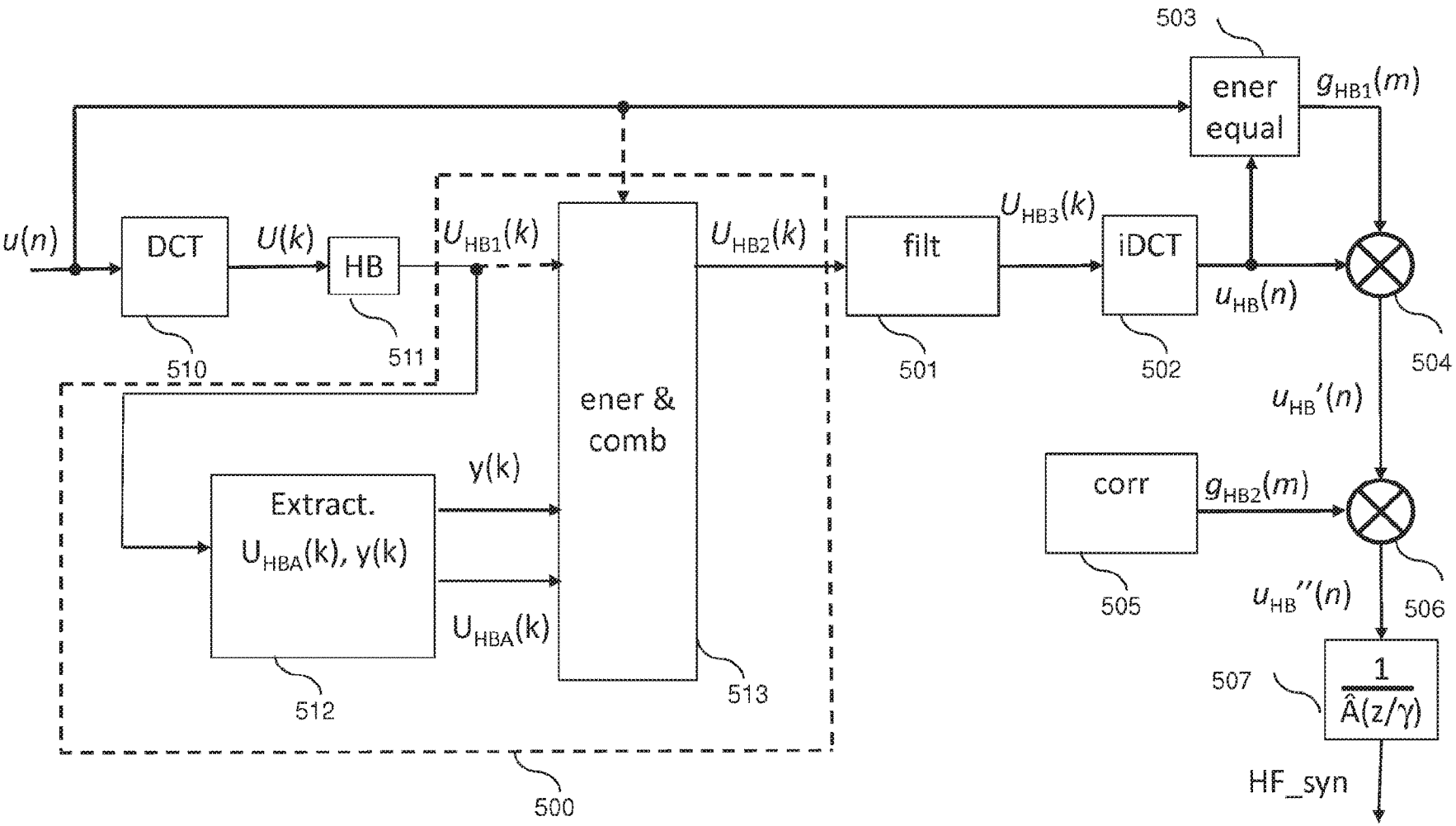
FIG. 5 illustrates an embodiment in the frequency domain of a band extension device according to the invention integrated into a decoder.

The high-band synthesis part is produced in the block 309 representing the band extension device according to the invention and which is detailed in FIG. 5 in an embodiment.

In order to align the decoded low and high bands, a delay (block 310) is introduced to synchronize the outputs of the blocks 306 and 309 and the high band synthesized at 16 kHz is resampled from 16 kHz to the frequency s (output of block 311). The value of the delay T will have to be adapted for the other cases (fs=32, 48 kHz) as a function of the processing operations implemented. It will be recalled that when fs=8 kHz, it is not necessary to apply the blocks 309 to 311 because the band of the signal at the output of the decoder is limited to 0-4000 Hz.

It will be noted that the extension method of the invention implemented in the block 309 according to the first embodiment preferentially does not introduce any additional delay relative to the low band reconstructed at 12.8 kHz; however, in variants of the invention (for example by using a time/frequency transformation with overlap), a delay will be able to be introduced. Thus, generally, the value of T in the block 310 will have to be adjusted according to the specific implementation. For example in the case where the post-processing of the low frequencies (block 306) is not used, the delay to be introduced for f-=16 kHz may be fixed at T=15.

The low and high bands are then combined (added) in the block 312 and the synthesis obtained is post-processed by 50 Hz high-pass filtering (of IIR type) of order 2, the coefficients of which depend on the frequency fs (block 313) and output post-processing with optional application of the "noise gate" in a manner similar to G.718 (block 314).

Figure 4:
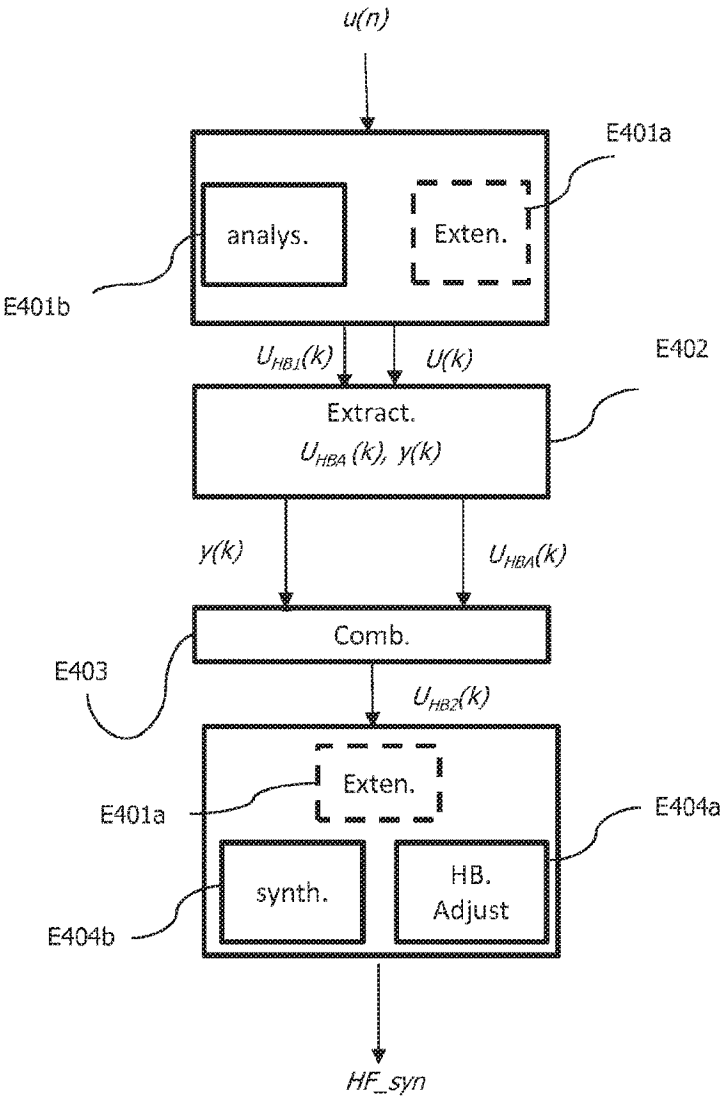
FIG. 4 illustrates, in flow diagram form, the main steps of a band extension method according to an embodiment of the invention.

The band extension device according to the invention, illustrated by the block 309 according to the embodiment of the decoder of FIG. 5, implements a band extension method (in the broad sense) described now with reference to FIG. 4.

This extension device can also be independent of the decoder and can implement the method described in FIG. 4 to perform a band extension of an existing audio signal stored or transmitted to the device, with an analysis of the audio signal to extract therefrom an excitation and an LPC filter, for example.

This device receives as input a signal decoded in a first frequency band termed the low band u(n) which can be in the domain of the excitation or in that of the signal. In the embodiment described here, a step of sub-band decomposition (E401*b*) by time frequency transform or filter bank is applied to the low band decoded signal to obtain the spectrum of the low band decoded signal U(k) for an implementation in the frequency domain.

A step E401*a* of extending the low band decoded signal in a second frequency band higher than the first frequency band, so as to obtain an extended low band decoded signal $U_{HB1}(k)$, can be performed on this low band decoded signal before or after the analysis step (decomposition into sub-bands). This extension step can comprise at one and the same time a resampling step and an extension step or simply a step of frequency translation or transposition as a function of the signal obtained at input. It will be noted that in variants, step E401*a* will be able to be performed at the end of the processing described in FIG. 4, that is to say on the combined signal, this processing then being carried out mainly on the low band signal before extension, the result being equivalent.

This step is detailed subsequently in the embodiment described with reference to FIG. 5.

A step E402 of extracting an ambience signal ($U_{HBA}(k)$) and tonal components (y(k)) is performed on the basis of the decoded low band signal (U(k)) or decoded and extended low band signal ($U_{HB1}(k)$). The ambience is defined here as the residual signal which is obtained by deleting the main (or dominant) harmonics (or tonal components) from the existing signal.

In most broadband signals (sampled at 16 kHz), the high band (>6 kHz) contains ambience information which is in general similar to that present in the low band.

The step of extracting the tonal components and the ambience signal comprises for example the following steps:

- detection of the dominant tonal components of the decoded (or decoded and extended) low band signal, in the frequency domain; and
- computation of a residual signal by extraction of the dominant tonal components to obtain the ambience signal.

This step can also be obtained by:

- obtaining of the ambience signal by computing a mean of the decoded (or decoded and extended) low band signal; and
- obtaining of the tonal components by subtracting the computed ambience signal, from the decoded or decoded and extended low band signal.

The tonal components and the ambience signal are thereafter combined in an adaptive manner with the aid of energy level control factors in step E403 to obtain a so-called combined signal ($U_{HB2}(k)$). The extension step E401*a* can then be implemented if it has not already been performed on the decoded low band signal.

Thus, the combining of these two types of signals makes it possible to obtain a combined signal with characteristics that are more suitable for certain types of signals such as musical signals and richer in frequency content and in the extended frequency band corresponding to the whole frequency band including the first and the second frequency band.

The band extension according to the method improves the quality for signals of this type with respect to the extension described in the AMR-WB standard.

Using a combination of ambience signal and of tonal components makes it possible to enrich this extension signal so as to render it closer to the characteristics of the true signal and not of an artificial signal.

This combining step will be detailed subsequently with reference to FIG. 5.

A synthesis step, which corresponds to the analysis at 401*b*, is performed at E404*b* to restore the signal to the time domain.

In an optional manner, a step of energy level adjustment of the high band signal can be performed at E404*a*, before and/or after the synthesis step, by applying a gain and/or by appropriate filtering. This step will be explained in greater detail in the embodiment described in FIG. 5 for the blocks 501 to 507.

In an exemplary embodiment, the band extension device 500 is now described with reference to FIG. 5 illustrating at one and the same time this device but also processing modules suitable for the implementation in a decoder of interoperable type with an AMR-WB coding. This device 500 implements the band extension method described previously with reference to FIG. 4.

Thus, the processing block 510 receives a decoded low band signal (u(n)). In a particular embodiment, the band extension uses the decoded excitation at 12.8 kHz (exc2 or u(n)) as output by the block 302 of FIG. 3.

This signal is decomposed into frequency sub-bands by the sub-band decomposition module 510 (which implements step E401*b* of FIG. 4) which in general carries out a transform or applies a filter bank, to obtain a decomposition into sub-bands U(k) of the signal u(n).

In a particular embodiment, a transform of DCT-IV (for "Discrete Cosine Transform"—type IV) (block 510) type is applied to the current frame of 20 ms (256 samples), without windowing, which amounts to directly transforming u(n) with n=0, . . . , 255 according to the following formula:

$$U(k) = \sum_{n=0}^{N-1} u(n)\cos\left(\frac{\pi}{N}\left(n+\frac{1}{2}\right)\left(k+\frac{1}{2}\right)\right)$$

in which N=256 and k=0, . . . , 255.

A transformation without windowing (or equivalently with an implicit rectangular window of the length of the frame) is possible when the processing is performed in the excitation domain, and not the signal domain. In this case no artifact (block effects) is audible, thereby constituting a significant advantage of this embodiment of the invention.

In this embodiment, the DCT-IV transformation is implemented by FFT according to the so-called "Evolve DCT (EDCT)" algorithm described in the article by D. M. Zhang, H. T. Li, *A Low Complexity Transform—Evolved DCT*, IEEE 14th International Conference on Computational Science and Engineering (CSE), August 2011, pp. 144-149, and implemented in the standards ITU-T G.718 Annex B and G.729.1 Annex E.

In variants of the invention, and without loss of generality, the DCT-IV transformation will be able to be replaced by other short-term time-frequency transformations of the same length and in the excitation domain or in the signal domain, such as an FFT (for "Fast Fourier Transform") or a DCT-II (Discrete Cosine Transform—type II). Alternatively, it will be possible to replace the DCT-IV on the frame by a transformation with overlap-addition and windowing of length greater than the length of the current frame, for example by using an MDCT (for "Modified Discrete Cosine Transform"). In this case, the delay T in the block 310 of FIG. 3 will have to be adjusted (reduced) appropriately as a function of the additional delay due to the analysis/synthesis by this transform.

In another embodiment, the sub-band decomposition is performed by applying a real or complex filter bank, for example of PQMF (Pseudo-QMF) type. For certain filter banks, for each sub-band in a given frame, one obtains not a spectral value but a series of temporal values associated with the sub-band; in this case, the embodiment favored in the invention can be applied by carrying out for example a transform of each sub-band and by computing the ambience signal in the domain of the absolute values, the tonal components still being obtained by differencing between the signal (in absolute value) and the ambience signal. In the case of a complex filter bank, the complex modulus of the samples will replace the absolute value.

In other embodiments, the invention will be applied in a system using two sub-bands, the low band being analyzed by transform or by filter bank.

In the case of a DCT, the DCT spectrum, U(k), of 256 samples covering the band 0-6400 Hz (at 12.8 kHz), is thereafter extended (block 511) into a spectrum of 320 samples covering the band 0-8000 Hz (at 16 kHz) in the following form:

$$U_{HB1}(k) = \begin{cases} 0 & k = 0, \ldots, 199 \\ U(k) & k = 200, \ldots, 239 \\ U(k + \text{start_band} - 240) & k = 240, \ldots, 319 \end{cases}$$

in which it is preferentially taken that start_band=160.

The block 511 implements step E401*a* of FIG. 4, that is to say the extension of the low band decoded signal. This step can also comprise a resampling from 12.8 to 16 kHz in the frequency domain, by adding ¼ of samples (k=240, . . . , 319) to the spectrum, the ratio of 16 and 12.8 being 5/4.

In the frequency band corresponding to the samples ranging from indices 200 to 239, the original spectrum is retained, to be able to apply thereto a progressive attenuation response of the high-pass filter in this frequency band and also to not introduce audible defects in the step of addition of the low-frequency synthesis to the high-frequency synthesis.

It will be noted that, in this embodiment, the generation of the oversampled and extended spectrum is performed in a frequency band ranging from 5 to 8 kHz therefore including a second frequency band (6.4-8 kHz) above the first frequency band (0-6.4 kHz).

Thus, the extension of the decoded low band signal is performed at least on the second frequency band but also on a part of the first frequency band.

Obviously, the values defining these frequency bands can be different depending on the decoder or the processing device in which the invention is applied.

Furthermore, the block 511 performs an implicit high-pass filtering in the 0-5000 Hz band since the first 200 samples of $U_{HB1}(k)$ are set to zero; as explained later, this high-pass filtering may also be complemented by a part of progressive attenuation of the spectral values of indices k=200, . . . , 255 in the 5000-6400 Hz band; this progressive attenuation is implemented in the block 501 but could be performed separately outside of the block 501. Equivalently, and in variants of the invention, the implementation of the high-pass filtering separated into blocks of coefficients of index k=0, . . . , 199 set to zero, of attenuated coefficients k=200, . . . , 255 in the transformed domain, will therefore be able to be performed in a single step.

In this exemplary embodiment and according to the definition of $U_{HB1}(k)$, it will be noted that the 5000-6000 Hz band of $U_{HB1}(k)$ (which corresponds to the indices k=200, . . . , 239) is copied from the 5000-6000 Hz band of U(k). This approach makes it possible to retain the original spectrum in this band and avoids introducing distortions in the 5000-6000 Hz band upon the addition of the HF synthesis with the LF synthesis—in particular the phase of the signal (implicitly represented in the DCT-IV domain) in this band is preserved.

The 6000-8000 Hz band of $U_{HB1}(k)$ is here defined by copying the 4000-6000 Hz band of U(k) since the value of start_band is preferentially set at 160.

In a variant of the embodiment, the value of start_band will be able to be made adaptive around the value of 160, without modifying the nature of the invention. The details of the adaptation of the start_band value are not described here because they go beyond the framework of the invention without changing its scope.

In most broadband signals (sampled at 16 kHz), the high band (>6 kHz) contains ambience information which is naturally similar to that present in the low band. The ambience is defined here as the residual signal which is obtained by deleting the main (or dominant) harmonics from the existing signal. The harmonicity level in the 6000-8000 Hz band is generally correlated with that of the lower frequency bands.

This decoded and extended low band signal is provided as input to the extension device 500 and in particular as input to the module 512. Thus the block 512 for extracting tonal components and an ambience signal implements step E402 of FIG. 4 in the frequency domain. The ambience signal, $U_{HBA}(k)$ for k=240, . . . , 319 (80 samples) is thus obtained for a second frequency band, so-called high-frequency, so as to combine it thereafter in an adaptive manner with the extracted tonal components y(k), in the combining block 513.

In a particular embodiment, the extraction of the tonal components and of the ambience signal (in the 6000-8000 Hz band) is performed according to the following operations:

Computation of the total energy of the extended decoded low band signal $ener_{HB}$:

$$ener_{HB} = \sum_{k=240}^{319} U_{HB1}(k)^2 + \varepsilon$$

where ε=0.1 (this value may be different, it is fixed here by way of example).

Computation of the ambience (in absolute value) which corresponds here to the mean level of the spectrum lev(i) (spectral line by spectral line) and computation of the energy $ener_{total}$ of the dominant tonal parts (in the high-frequency spectrum)

For i=0 . . . L−1, this mean level is obtained through the following equation:

$$lev(i) = \frac{1}{fn(i) - fb(i) + 1} \sum_{j=fb(i)}^{fn(i)} |U_{HB1}(j + 240)|$$

This corresponds to the mean level (in absolute value) and therefore represents a sort of envelope of the spectrum. In this embodiment, L=80 and represents the length of the spectrum and the index i from 0 to L−1 corresponds to the indices j+240 from 240 to 319, i.e. the spectrum from 6 to 8 kHz.

In general fb(i)=i−7 and fn(i)=i+7, however the first and last 7 indices (i=0, . . . , 6 and i=L−7, . . . , L−1) require special processing and without loss of generality we then define:

$$fb(i)=0 \text{ and } fn(i)=i+7 \text{ for } i=0, \ldots, 6$$

$$fb(i)=i-7 \text{ and } fn(i)=L-1 \text{ for } i=L-7, \ldots, L-1$$

In variants of the invention, the mean of $|U_{HB1}(j+240)|$, j=fb(i), . . . , fn(i), may be replaced with a median value over the same set of values, i.e. $lev(i)=median_{j=fb(i), \ldots, fn(i)}(|U_{HB1}(j+240)|)$ This variant has the defect of being more complex (in terms of number of computations) than a sliding mean. In other variants a non-uniform weighting may be applied to the averaged terms, or the median filtering may be replaced for example with other nonlinear filters of "stack filters" type.

The residual signal is also computed:

$$y(i)=|U_{HB1}(i+240)|-lev(i),\ i=0, \ldots, L-1$$

which corresponds (approximately) to the tonal components if the value y(i) at a given spectral line i is positive (y(i)>0). This computation therefore involves an implicit detection of the tonal components. The tonal parts are therefore implicitly detected with the aid of the intermediate term y(i) representing an adaptive threshold. The detection condition being y(i)>0. In variants of the invention this condition may be changed for example by defining an adaptive threshold dependent on the local envelope of the signal or in the form y(i)>lev(i)+x dB where x has a predefined value (for example x=10 dB).

The energy of the dominant tonal parts is defined by the following equation:

$$ener_{tonal} = \sum_{i=0 \ldots 7 | y(i)|>0} y(i)^2$$

Other schemes for extracting the ambience signal can of course be envisaged. For example, this ambience signal can be extracted from a low-frequency signal or optionally another frequency band (or several frequency bands).

The detection of the tonal spikes or components may be done differently.

The extraction of this ambience signal could also be done on the decoded but not extended excitation, that is to say before the spectral extension or translation step, that is to say for example on a portion of the low-frequency signal rather than directly on the high-frequency signal.

In a variant embodiment, the extraction of the tonal components and of the ambience signal is performed in a different order and according to the following steps:

detection of the dominant tonal components of the decoded (or decoded and extended) low band signal, in the frequency domain;

computation of a residual signal by extraction of the dominant tonal components to obtain the ambience signal.

This variant can for example be carried out in the following manner: A spike (or tonal component) is detected at a spectral line of index i in the spectrum of amplitude $|U_{HB1}(i+240)|$ if the following criterion is satisfied:

$$|U_{HB1}(i+240)|>|U_{HB1}(i+240-1)| \text{ and } |U_{HB1}(i+240)|>|U_{HB1}(i+240+1)|,$$

for i=0, . . . , L−1. As soon as a spike is detected at the spectral line of index i a sinusoidal model is applied so as to estimate the amplitude, frequency and optionally phase parameters of a tonal component associated with this spike. The details of this estimation are not presented here but the estimation of the frequency can typically call upon a parabolic interpolation over 3 points so as to locate the maximum of the parabola approximating the 3 points of amplitude $|U_{HB1}(i+240)|$ (expressed as dB), the amplitude estimation being obtained by way of this same interpolation. As the transform domain used here (DCT-IV) does not make it possible to obtain the phase directly, it will be possible, in one embodiment, to neglect this term, but in variants it will be possible to apply a quadrature transform of DST type to estimate a phase term. The initial value of y(i) is set to zero for i=0, . . . , L−1. The sinusoidal parameters (frequency, amplitude, and optionally phase) of each tonal component being estimated, the term y(i) is then computed as the sum of predefined prototypes (spectra) of pure sinusoids transformed into the DCT-IV domain (or other domain if some other sub-band decomposition is used) according to the estimated sinusoidal parameters. Finally, an absolute value is applied to the terms y(i) to express the domain of the amplitude spectrum as absolute values.

Other schemes for determining the tonal components are possible, for example it would also be possible to compute an envelope of the signal env(i) by spline interpolation of the local maximum values (detected spikes) of $|U_{HB1}(i+240)|$, to lower this envelope by a certain level in dB in order to detect the tonal components as the spikes which exceed this envelope and to define y(i) as $$y(i)=\max(|U_{HB1}(i+240)|-env(i),0)$$

In this variant the ambience is therefore obtained through the equation:

$$lev(i)=|U_{HB1}(i+240)|-y(i),\ i=0, \ldots, L-1$$

In other variants of the invention, the absolute value of the spectral values will be replaced for example by the square of the spectral values, without changing the principle of the invention; in this case a square root will be necessary in order to return to the signal domain, this being more complex to carry out.

The combining module 513 performs a combining step by adaptive mixing of the ambience signal and of the tonal components. Accordingly, an ambience level control factor F is defined by the following equation:

$$\Gamma = \beta \frac{ener_{HB} - ener_{tonal}}{ener_{HB} - \beta ener_{tonal}}$$

β being a factor, an exemplary computation of which is given hereinbelow.

To obtain the extended signal, we first obtain the combined signal in absolute values for i=0 . . . L−1:

$$y'(i) = \begin{cases} \Gamma y(i) + \frac{1}{\Gamma} lev(i) & y(i) > 0 \\ y(i) + \frac{1}{\Gamma} lev(i) & y(i) \le 0 \end{cases}$$

to which are applied the signs of $U_{HB1}(k)$:

$$y''(i) = \mathrm{sgn}(U_{HB1}(i+240)) \cdot y'(i)$$

where the function sgn(.) gives the sign:

$$\mathrm{sgn}(x) = \begin{cases} 1 & x \ge 0 \\ -1 & x < 0 \end{cases}$$

By definition the factor Γ is >1. The tonal components, detected spectral line by spectral line by the condition y(i)>0, are reduced by the factor Γ; the mean level is amplified by the factor 1/Γ.

In the adaptive mixing block 513, a control factor for the energy level is computed as a function of the total energy of the decoded (or decoded and extended) low band signal and of the tonal components.

In a preferred embodiment of the adaptive mixing, the energy adjustment is performed in the following manner:

$$U_{HB2}(k) = \mathrm{fac} \cdot y''(k-240),\ k = 240, \ldots, 319$$

$U_{HB2}(k)$ being the band extension combined signal.

The adjustment factor is defined by the following equation:

$$fac = \gamma \sqrt{\frac{ener_{HB}}{\sum_{i=0}^{L-1} y''(i)}}$$

Where γ makes it possible to avoid over-estimation of the energy. In an exemplary embodiment, we compute β so as to retain the same level of ambience signal with respect to the energy of the tonal components in the consecutive bands of the signal. We compute the energy of the tonal components in three bands: 2000-4000 Hz, 4000-6000 Hz and 6000-8000 Hz, with $$E_{N2-4} = \sum_{k \in N(80,159)} U'^2(k)$$

$$E_{N4-6} = \sum_{k \in N(160,239)} U'^2(k)$$

$$E_{N4-6} = \sum_{k \in N(240,319)} U'^2(k)$$

in which

-continued $$U'(k) = \begin{cases} \sqrt{\frac{\sum_{k=160}^{239} U^2(k)}{\sum_{k=80}^{150} U^2(k)}}\, U(k) & k = 80, \ldots, 159 \\ U(k) & k = 160, \ldots, 239 \\ \sqrt{\frac{\sum_{k=160}^{239} U^2(k)}{\sum_{k=240}^{319} U_{HB1}^2(k)}}\, U_{HB1}(k) & k = 240, \ldots, 319 \end{cases}$$

And where $N(k_1, k_2)$ is the set of the indices k for which the coefficient of index k is classified as being associated with the tonal components. This set may be for example obtained by detecting the local spikes in U'(k) satisfying |U'(k)|>lev (k) or lev(k) is computed as the mean level of the spectrum, spectral line by spectral line.

It may be noted that other schemes for computing the energy of the tonal components are possible, for example by taking the median value of the spectrum over the band considered. We fix β in such a way that the ratio between the energy of the tonal components in the 4-6 kHz and 6-8 kHz bands is the same as between the 2-4 kHz and 4-6 kHz bands:

$$\beta = \frac{\rho - E_{N6-8}}{\sum_{k=160}^{239} U^2(k) - E_{N6-8}}$$

where $$E_{N4-6} = \max(E_{N4-6}, E_{N2-4}),\ \rho = \frac{E_{N4-6}^2}{E_{N2-4}},\ \rho = \max(\rho, E_{N6-8})$$

and max(.,.) is the function which gives the maximum of the two arguments.

In variants of the invention, the computation of β may be replaced with other schemes. For example, in a variant, it will be possible to extract (compute) various parameters (or "features") characterizing the low band signal, including a "tilt" parameter similar to that computed in the AMR-WB codec, and the factor β will be estimated as a function of a linear regression on the basis of these various parameters by limiting its value between 0 and 1. The linear regression will, for example, be able to be estimated in a supervised manner by estimating the factor β by being given the original high band in a learning base. It will be noted that the way in which β is computed does not limit the nature of the invention.

Thereafter, the parameter β can be used to compute γ by taking account of the fact that a signal with an ambience signal added in a given band is in general perceived as stronger than a harmonic signal with the same energy in the same band. If we define α to be the quantity of ambience signal added to the harmonic signal:

$$\alpha = \sqrt{1-\beta}$$

it will be possible to compute γ as a decreasing function of α, for example $\gamma = b - a\sqrt{\alpha}$, b=1.1, a=1.2 and γ limited from 0.3 to 1. Here again, other definitions of α and γ are possible within the framework of the invention.

At the output of the band extension device 500, the block 501, in a particular embodiment, carries out in an optional manner a dual-operation of application of bandpass filter frequency response and of de-emphasis (or deaccentuation) filtering in the frequency domain.

In a variant of the invention, the de-emphasis filtering will be able to be performed in the time domain, after the block 502, even before the block 510; however, in this case, the bandpass filtering performed in the block 501 may leave certain low-frequency components of very low levels which are amplified by de-emphasis, which can modify, in a slightly perceptible manner, the decoded low band. For this reason, it is preferred here to perform the de-emphasis in the frequency domain. In the preferred embodiment, the coefficients of index k=0, . . . , 199 are set to zero, so the de-emphasis is limited to the higher coefficients.

The excitation is first de-emphasized according to the following equation:

$$U'_{HB2}(k) = \begin{cases} 0 & k = 0, \ldots, 199 \\ G_{deemph}(k-200)U_{HB2}(k) & k = 200, \ldots, 255 \\ G_{deemph}(55)U_{HB2}(k) & k = 256, \ldots, 319 \end{cases}$$

in which $G_{deemph}(k)$ is the frequency response of the filter $1/(1-0.68\ z^{-1})$ over a restricted discrete frequency band. By taking into account the discrete (odd) frequencies of the DCT-IV, $G_{deemph}(k)$ is defined here as:

$$G_{deemph}(k) = \frac{1}{|e^{j\theta_k} - 0.68|},$$

k=0, . . . , 255 in which $$\theta_k = \frac{256 - 80 + k + \frac{1}{2}}{256}.$$

In the case where a transformation other than DCT-IV is used, the definition of $\theta_k$ will be able to be adjusted (for example for even frequencies).

It should be noted that the de-emphasis is applied in two phases for k=200, . . . , 255 corresponding to the 5000-6400 Hz frequency band, where the response $1/(1-0.68\ z^{-1})$ is applied as at 12.8 kHz, and for k=256, . . . , 319 corresponding to the 6400-8000 Hz frequency band, where the response is extended from 16 kHz here to a constant value in the 6.4-8 kHz band.

It can be noted that, in the AMR-WB codec, the HF synthesis is not de-emphasized. In the embodiment presented here, the high-frequency signal is on the contrary de-emphasized so as to restore it to a domain consistent with the low-frequency signal (0-6.4 kHz) which exits the block 305 of FIG. 3. This is important for the estimation and the subsequent adjustment of the energy of the HF synthesis.

In a variant of the embodiment, in order to reduce the complexity, it will be possible to set $G_{deemph}(k)$ at a constant value independent of k, by taking for example $G_{deemph}(k)$= 0.6 which corresponds approximately to the average value of $G_{deemph}(k)$ for k=200, . . . , 319 in the conditions of the embodiment described above.

In another variant of the embodiment of the decoder, the de-emphasis will be able to be carried out in an equivalent manner in the time domain after inverse DCT.

In addition to the de-emphasis, a bandpass filtering is applied with two separate parts: one, high-pass, fixed, the other, low-pass, adaptive (function of the bit rate).

This filtering is performed in the frequency domain.

In the preferred embodiment, the low-pass filter partial response is computed in the frequency domain as follows:

$$G_{lp}(k) = 1 - 0.999\frac{k}{N_{lp} - 1}$$

in which $N_{lp}$=60 at 6.6 kbit/s, 40 at 8.85 kbit/s, and 20 at the bit rates >8.85 bit/s. Then, a bandpass filter is applied in the form:

$$U_{HB3}(k) = \begin{cases} 0 & k = 0, \ldots, 199 \\ G_{hp}(k-200)H'_{HB2}(k) & k = 200, \ldots, 255 \\ U'_{HB2}(k) & k = 256, \ldots, 319 - N_{lp} \\ G_{lp}(k-320-N_{lp})U'_{HB2}(k) & k = 320 - N_{lp}, \ldots, 319 \end{cases}$$

The definition of $G_{hp}(k)$ k=0, . . . , 55, is given, for example, in table 1 below.

TABLE 1

| K | $g_{hp}(k)$ |
|---|---|
| 0 | 0.001622428 |
| 1 | 0.004717458 |
| 2 | 0.008410494 |
| 3 | 0.012747280 |
| 4 | 0.017772424 |
| 5 | 0.023528982 |
| 6 | 0.030058032 |
| 7 | 0.037398264 |
| 8 | 0.045585564 |
| 9 | 0.054652620 |
| 10 | 0.064628539 |
| 11 | 0.075538482 |
| 12 | 0.087403328 |
| 13 | 0.100239356 |
| 14 | 0.114057967 |
| 15 | 0.128865425 |
| 16 | 0.144662643 |
| 17 | 0.161445005 |
| 18 | 0.179202219 |
| 19 | 0.197918220 |
| 20 | 0.217571104 |
| 21 | 0.238133114 |
| 22 | 0.259570657 |
| 23 | 0.281844373 |
| 24 | 0.304909235 |
| 25 | 0.328714699 |
| 26 | 0.353204886 |
| 27 | 0.378318805 |
| 28 | 0.403990611 |
| 29 | 0.430149896 |
| 30 | 0.456722014 |
| 31 | 0.483628433 |
| 32 | 0.510787115 |
| 33 | 0.538112915 |
| 34 | 0.565518011 |
| 35 | 0.592912340 |
| 36 | 0.620204057 |
| 37 | 0.647300005 |
| 38 | 0.674106188 |
| 39 | 0.700528260 |
| 40 | 0.726472003 |
| 41 | 0.751843820 |
| 42 | 0.776551214 |
| 43 | 0.800503267 |
| 44 | 0.823611104 |
| 45 | 0.845788355 |
| 46 | 0.866951597 |
| 47 | 0.887020781 |
| 48 | 0.905919644 |
| 49 | 0.923576092 |
| 50 | 0.939922577 |

TABLE 1-continued

| K | $g_{hp}(k)$ |
|---|---|
| 51 | 0.954896429 |
| 52 | 0.968440179 |
| 53 | 0.980501849 |
| 54 | 0.991035206 |
| 55 | 1.000000000 |

It will be noted that, in variants of the invention, the values of $G_{hp}(k)$ will be able to be modified while keeping a progressive attenuation. Similarly, the low-pass filtering with variable bandwidth, $G_{lp}(k)$, will be able to be adjusted with values or a frequency support that are different, without changing the principle of this filtering step.

It will also be noted that the bandpass filtering will be able to be adapted by defining a single filtering step combining the high-pass and low-pass filtering.

In another embodiment, the bandpass filtering will be able to be performed in an equivalent manner in the time domain (as in the block 112 of FIG. 1) with different filter coefficients according to the bit rate, after an inverse DCT step. However, it will be noted that it is advantageous to perform this step directly in the frequency domain because the filtering is performed in the domain of the LPC excitation and therefore the problems of circular convolution and of edge effects are very limited in this domain.

The inverse transform block 502 performs an inverse DCT on 320 samples to find the high-frequency signal sampled at 16 kHz. Its implementation is identical to the block 510, because the DCT-IV is orthonormal, except that the length of the transform is 320 instead of 256, and the following is obtained:

$$u_{HB}(n) = \sum_{k=0}^{N_{16k}-1} U_{HB3}(k)\cos\left(\frac{\pi}{N_{16k}}\left(k+\frac{1}{2}\right)\left(n+\frac{1}{2}\right)\right)$$

where $N_{16k}=320$ and k=0, . . . , 319.

In the case where the block 510 is not a DCT, but some other transformation or decomposition into sub-bands, the block 502 carries out the synthesis corresponding to the analysis carried out in the block 510.

The sampled signal at 16 kHz is thereafter in an optional manner scaled by gains defined per sub-frame of 80 samples (block 504).

In a preferred embodiment, a gain $g_{HB1}(m)$ is first computed (block 503) per sub-frame by ratios of energy of the sub-frames such that, in each sub-frame of index m=0, 1, 2 or 3 of the current frame:

$$g_{HB1}(m) = \sqrt{\frac{e_3(m)}{e_2(m)}}$$

in which $$e_1(m) = \sum_{n=0}^{63} u(n+64m)^2 + \varepsilon$$

$$e_2(m) = \sum_{n=0}^{79} u_{HB}(n+80m)^2 + \varepsilon$$

-continued $$e_3(m) = e_1(m)\frac{\sum_{n=0}^{319} u_{HB}(n)^2 + \varepsilon}{\sum_{n=0}^{255} u(n)^2 + \varepsilon}$$

with ε=0.01. The gain per sub-frame $g_{HB1}(m)$ can be written in the form:

$$g_{HB1}(m) = \sqrt{\frac{\dfrac{\sum_{n=0}^{63} u(n+64m)^2 + \varepsilon}{\sum_{n=0}^{255} u(n)^2 + \varepsilon}}{\dfrac{\sum_{n=0}^{79} u_{HB}(n+80m)^2 + \varepsilon}{\sum_{n=0}^{319} u_{HB}(n)^2 + \varepsilon}}}$$

which shows that, in the signal $u_{HB}$, the same ratio between energy per sub-frame and energy per frame as in the signal u(n) is assured.

The block 504 performs the scaling of the combined signal (included in step E404*a* of FIG. 4) according to the following equation:

$$u_{HB}'(n)=g_{HB1}(m)u_{HB}(n),\ n=80m, \ldots ,80(m+1)-1$$

Figure 1:
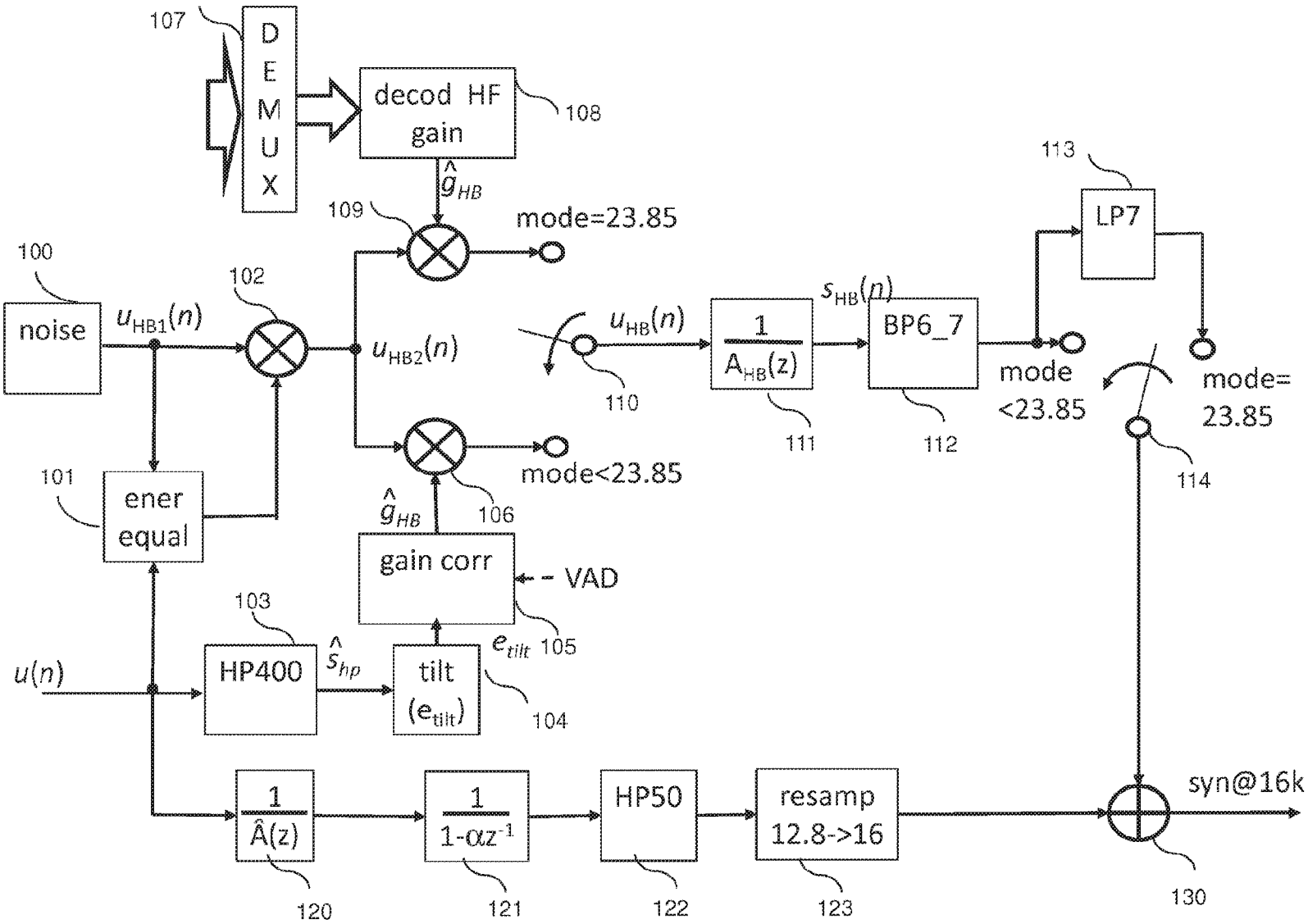
FIG. 1 illustrates a part of a decoder of AMR-WB type implementing frequency band extension steps of the prior art and as described previously.

It will be noted that the implementation of the block 503 differs from that of the block 101 of FIG. 1, because the energy at the current frame level is taken into account in addition to that of the sub-frame. This makes it possible to have the ratio of the energy of each sub-frame in relation to the energy of the frame. Ratios of energy (or relative energies) are therefore compared rather than the absolute energies between low band and high band.

Thus, this scaling step makes it possible to retain, in the high band, the ratio of energy between the sub-frame and the frame in the same way as in the low band.

In an optional manner, the block 506 thereafter performs the scaling of the signal (included in step E404*a* of FIG. 4) according to the following equation:

$$u_{HB}''(n)=g_{HB2}(m)u_{HB}'(n),\ n=80m, \ldots ,80(m+1)-1$$

where the gain $g_{HB2}(m)$ is obtained from the block 505 by executing the blocks 103, 104 and 105 of the AMR-WB codec (the input of the block 103 being the excitation decoded in low band, u(n)). The blocks 505 and 506 are useful for adjusting the level of the LPC synthesis filter (block 507), here as a function of the tilt of the signal. Other schemes for computing the gain $g_{HB2}(m)$ are possible without changing the nature of the invention.

Finally, the signal, $u_{HB}'(n)$ or $u_{HB}''(n)$, is filtered by the filtering module 507 which can be embodied here by taking as transfer function 1/Â(z/γ), where γ=0.9 at 6.6 kbit/s and γ=0.6 at the other bit rates, thereby limiting the order of the filter to order 16.

In a variant, this filtering will be able to be performed in the same way as is described for the block 111 of FIG. 1 of the AMR-WB decoder, but the order of the filter changes to 20 at the 6.6 bit rate, which does not significantly change the quality of the synthesized signal. In another variant, it will be possible to perform the LPC synthesis filtering in the frequency domain, after having computed the frequency response of the filter implemented in the block 507.

In variant embodiments of the invention, the coding of the low band (0-6.4 kHz) will be able to be replaced by a CELP coder other than that used in AMR-WB, such as, for example, the CELP coder in G.718 at 8 kbit/s. With no loss of generality, other wide-band coders or coders operating at frequencies above 16 kHz, in which the coding of the low band operates with an internal frequency at 12.8 kHz, could be used. Moreover, the invention can obviously be adapted to sampling frequencies other than 12.8 kHz, when a low-frequency coder operates with a sampling frequency lower than that of the original or reconstructed signal. When the low-band decoding does not use linear prediction, there is no excitation signal to be extended, in which case it will be possible to perform an LPC analysis of the signal reconstructed in the current frame and an LPC excitation will be computed so as to be able to apply the invention.

Finally, in another variant of the invention, the excitation or the low band signal (u(n) is resampled, for example by linear interpolation or cubic "spline" interpolation, from 12.8 to 16 kHz before transformation (for example DCT-IV) of length 320. This variant has the defect of being more complex, since the transform (DCT-IV) of the excitation or of the signal is then computed over a greater length and the resampling is not performed in the transform domain.

Furthermore, in variants of the invention, all the computations necessary for the estimation of the gains ($G_{HBN}$, $g_{HB1}(m)$, $g_{HB2}(m)$ $g_{HBN}$, . . . ) will be able to be performed in a logarithmic domain.

Figure 6:
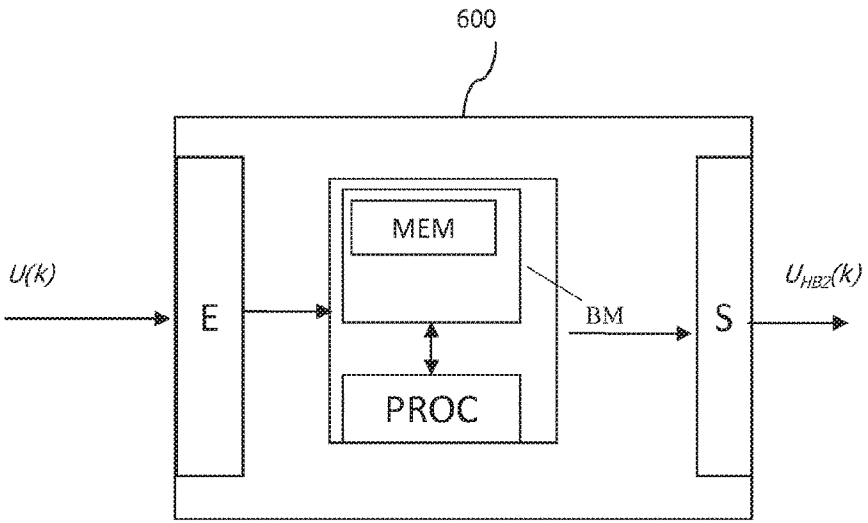
FIG. 6 illustrates a hardware implementation of a band extension device according to the invention.

FIG. 6 represents an exemplary physical embodiment of a band extension device 600 according to the invention. The latter can form an integral part of an audio frequency signal decoder or of an equipment item receiving audio frequency signals, decoded or not.

This type of device comprises a processor PROC cooperating with a memory block BM comprising a storage and/or working memory MEM.

Such a device comprises an input module E able to receive a decoded or extracted audio signal in a first frequency band termed the low band restored to the frequency domain (U(k)). It comprises an output module S able to transmit the extension signal in a second frequency band ($U_{HB2}(k)$) for example to a filtering module 501 of FIG. 5.

The memory block can advantageously comprise a computer program comprising code instructions for the implementation of the steps of the band extension method within the meaning of the invention, when these instructions are executed by the processor PROC, and in particular the steps of extracting (E402) tonal components and an ambience signal from a signal arising from the decoded low band signal (U(k)), of combining (E403) the tonal components (y(k)) and the ambience signal ($U_{HBA}(k)$) by adaptive mixing using energy level control factors to obtain an audio signal, termed the combined signal ($U_{HB2}(k)$), of extending (E401*a*) over at least one second frequency band higher than the first frequency band the low band decoded signal before the extraction step or the combined signal after the combining step.

Typically, the description of FIG. 4 reprises the steps of an algorithm of such a computer program. The computer program can also be stored on a memory medium that can be read by a reader of the device or that can be downloaded into the memory space thereof.

The memory MEM stores, generally, all the data necessary for the implementation of the method.

In one possible embodiment, the device thus described can also comprise low-band decoding functions and other processing functions described for example in FIGS. 5 and 3 in addition to the band extension functions according to the invention.

Although the present disclosure has been described with reference to one or more examples, workers skilled in the art will recognize that changes may be made in form and detail without departing from the scope of the disclosure and/or the appended claims.

What is claimed is:

1. A method comprising:

obtaining a decoded audio signal, wherein the decoded audio signal has been decoded in a first frequency band;

extending frequencies of the decoded audio signal into a second frequency band, to produce a frequency-extended decoded audio signal, wherein the second frequency band is higher than the first frequency band;

obtaining dominant tonal components from the frequency-extended decoded audio signal;

obtaining an ambience signal from the frequency-extended decoded audio signal, wherein the ambience signal is the frequency-extended decoded audio signal with the dominant tonal components removed;

combining the dominant tonal components and the ambience signal by adaptive mixing using energy level control factors to obtain a combined signal;

applying de-emphasis filtering and bandpass filtering to the combined signal, wherein the de-emphasis filtering is performed in the frequency domain, wherein the de-emphasis filtering is limited to higher coefficients of the combined signal, wherein the combined signal is de-emphasized according to the equation:

$$U'_{HB2}(k) = \begin{cases} 0 & k = 0, \ldots, 199 \\ G_{deemph}(k-200)U_{HB2}(k) & k = 200, \ldots, 255 \\ G_{deemph}(55)U_{HB2}(k) & k = 256, \ldots, 319 \end{cases}$$

wherein $U_{HB2}(k)$ is the combined signal and $G_{deemph}(k)$ is the discrete frequency response of the filter $1/(1-0.68\ z^{-1})$ over a restricted frequency band.

2. The method of claim 1, wherein the frequency response $G_{deemph}(k)$ is defined by $$G_{deemph}(k) = \frac{1}{|e^{j\vartheta k} - 0.68|}, k = 0, \ldots, 255$$

wherein $$\vartheta_k = \frac{256 - 80 + k + \frac{1}{2}}{256}.$$

3. The method of claim 2, wherein the bandpass filtering is applied using a fixed high-pass filter and an adaptive low-pass filter.

4. The method of claim 3, wherein a partial response of the adaptive low pass filter is computed in the frequency domain as:

$$G_{lp}(k) = 1 - 0.999\frac{k}{N_{lp} - 1}$$

wherein $N_{lp}$ are values of the low pass filter, and $N_{lp}$=60 at 6.6 kbit/s, 40 at 8.85 kbit/s, and 20 at rates greater than 8.85 kbits/s.

5. The method of claim 4, wherein the bandpass filter is applied in the form:

$$U_{HB3}(k) = \begin{cases} 0 & k = 0, \ldots, 199 \\ G_{hp}(k - 200)U'_{HB2}(k) & k = 200, \ldots, 255 \\ U'_{HB2}(k) & k = 256, \ldots, 319 - N_{lp} \\ G_{lp}(k - 320 - N_{lp})U'_{HB2}(k) & k = 320 - N_{lp}, \ldots, 319 \end{cases}$$

wherein $U_{HB2}'(k)$ is the de-emphasized combined signal and $G_{hp}(k)$ are values of the fixed high-pass filter.

6. The method of claim 5, wherein the values of the high-pass filter $G_{hp}(k)$ are given in the table:

| k | $G_{hp}(k)$ |
|---|---|
| 0 | 0.001622428 |
| 1 | 0.004717458 |
| 2 | 0.008410494 |
| 3 | 0.012747280 |
| 4 | 0.017772424 |
| 5 | 0.023528982 |
| 6 | 0.030058032 |
| 7 | 0.037398264 |
| 8 | 0.045585564 |
| 9 | 0.054652620 |
| 10 | 0.064628539 |
| 11 | 0.075538482 |
| 12 | 0.087403328 |
| 13 | 0.100239356 |
| 14 | 0.114047967 |
| 15 | 0.128865425 |
| 16 | 0.144662643 |
| 17 | 0.161445005 |
| 18 | 0.179202219 |
| 19 | 0.197918220 |
| 20 | 0.217571104 |
| 21 | 0.238133114 |
| 22 | 0.259570657 |
| 23 | 0.281844373 |
| 24 | 0.304909235 |
| 25 | 0.328714699 |
| 26 | 0.353204886 |
| 27 | 0.378318805 |
| 28 | 0.403990611 |
| 29 | 0.430149896 |
| 30 | 0.456722014 |
| 31 | 0.483628433 |
| 32 | 0.510787115 |
| 33 | 0.538112915 |
| 34 | 0.565518011 |
| 35 | 0.592912340 |
| 36 | 0.620204057 |
| 37 | 0.647300005 |
| 38 | 0.674106188 |
| 39 | 0.700528260 |
| 40 | 0.726472003 |
| 41 | 0.751843820 |
| 42 | 0.776551214 |
| 43 | 0.800503267 |
| 44 | 0.823611104 |
| 45 | 0.845788355 |
| 46 | 0.866951597 |
| 47 | 0.887020781 |
| 48 | 0.905919644 |
| 49 | 0.923576092 |
| 50 | 0.939922577 |

-continued

| k | $G_{hp}(k)$ |
|---|---|
| 51 | 0.954896429 |
| 52 | 0.968440179 |
| 53 | 0.980501849 |
| 54 | 0.991035206 |
| 55 | 1.000000000. |

7. A device comprising a non-transitory computer readable memory comprising instructions stored thereon, a processor circuit configured by the instructions to:

obtain a decoded signal, wherein the decoded audio signal has been decoded in a first frequency band;

extend frequencies of the decoded audio signal into a second frequency band, to produce a frequency-extended decoded audio signal, wherein the second frequency band is higher than the first frequency band;

obtain dominant tonal components from the frequency-extended decoded audio signal;

obtain an ambience signal from the frequency-extended decoded audio signal, wherein the ambience signal is the frequency-extended decoded audio signal with the dominant tonal components removed;

combine the dominant tonal components and the ambience signal by adaptive mixing using energy level control factors to obtain aa combined signal; and apply de-emphasis filtering and bandpass filtering the combined signal, wherein the de-emphasis filtering is performed in the frequency domain, wherein the de-emphasis filtering is limited to higher coefficients of the combined signal, wherein the combined signal is de-emphasized according to the equation:

$$U'_{HB2}(k) = \begin{cases} 0 & k = 0, \ldots, 199 \\ G_{deemph}(K - 200)U_{HB2}(k) & k = 200, \ldots, 225 \\ G_{deemph}(55)U_{HB2}(k) & k = 256, \ldots, 319 \end{cases}$$

wherein $U_{HB2}(k)$ is the combined signal and $G_{deemph}(k)$ is the discrete frequency response of the filter $1/(1-0.68\,z^{-1})$ over a restricted frequency band.

8. The device of claim 7, wherein the frequency response $G_{deemph}(k)$ is defined by $$G_{deemph}(k) = \frac{1}{|e^{j\vartheta k} - 0.68|}, k = 0, \ldots, 255$$

wherein $$\vartheta_k = \frac{256 - 80 + k + \frac{1}{2}}{256}.$$

9. The device of claim 8, wherein the bandpass filtering is applied using a fixed high-pass filter and an adaptive low-pass filter.

10. The device of claim 9, wherein a partial response of the adaptive low pass filter is computed in the frequency domain as:

$$G_{lp}(k) = 1 - 0.999\frac{k}{N_{lp} - 1}$$

wherein $N_{lp}$ are values of the low pass filter, and $N_{lp}$=60 at 6.6 kbit/s, 40 at 8.85 kbit/s, and 20 at rates greater than 8.85 kbits/s.

11. The device of claim 10, wherein the bandpass filter is applied in the form:

$$U_{HB3}(k) = \begin{cases} 0 & k = 0, \ldots, 199 \\ G_{hp}(k - 200)H'_{HB2}(k) & k = 200, \ldots, 255 \\ U'_{HB2}(k) & k = 256, \ldots, 319 - N_{lp} \\ G_{lp}(k - 320 - N_{lp})U'_{HB2}(k) & k = 320 - N_{lp}, \ldots, 319 \end{cases}$$

wherein $U_{HB2}$'(k) is the de-emphasized combined signal and $G_{hp}$(k) are values of the fixed high-pass filter.

12. A method, comprising:

obtaining a decoded audio signal, wherein the decoded audio signal has been decoded in a first frequency band;

obtaining dominant tonal components from the decoded audio signal;

obtaining an ambience signal from the decoded audio signal, wherein the ambience signal is the decoded audio signal with the dominant tonal components removed;

combining the dominant tonal components and the ambience signal by adaptive mixing using energy level control factors to obtain a combined signal;

extending frequencies of the combined signal into a second frequency band, to produce a frequency-extended combined signal, wherein the second frequency band is higher than the first frequency band; and applying de-emphasis filtering and bandpass filtering to the combined signal, wherein the combined signal is de-emphasized according to the equation:

$$U'_{HB2}(k) = \begin{cases} 0 & k = 0, \ldots, 199 \\ G_{deemph}(K - 200)U_{HB2}(k) & k = 200, \ldots, 225 \\ G_{deeph}(55)U_{HB2}(k) & k = 256, \ldots, 319 \end{cases}$$

Wherein $U_{HB2}$ (k) is the combined signal and $G_{deemph}$(k) is the discrete frequency response of the filter $1/(1-0.68\ z^{-1})$ over a restricted frequency band.

13. The method of claim 12, wherein the bandpass filtering is applied using a fixed high-pass filter and an adaptive low-pass filter, wherein a partial response of the adaptive low pass filter is computed in the frequency domain as:

$$G_{lp}(k) = 1 - 0.999\frac{k}{N_{lp} - 1}$$

wherein $N_{lp}$ are values of the low pass filter, and $N_{lp}$=60 at 6.6 kbit/s, 40 at 8.85 kbit/s, and 20 at rates greater than 8.85 kbits/s.

* * * * *